United States Patent [19]

Santén et al.

[11] Patent Number: 4,466,807

[45] Date of Patent: Aug. 21, 1984

[54] MANUFACTURE OF A GAS CONTAINING MONOXIDE AND HYDROGEN GAS FROM A STARTING MATERIAL CONTAINING CARBON AND/OR HYDROCARBON

[75] Inventors: Sven Santén; Börje Johansson, both of Hofers, Sweden

[73] Assignee: SKF Steel Engineering Aktiebolag, Hofors, Sweden

[21] Appl. No.: 324,695

[22] Filed: Nov. 25, 1981

[30] Foreign Application Priority Data

Mar. 10, 1981 [SE] Sweden ..... 8101496

[51] Int. Cl.[3] ..... C10J 3/18; C10J 3/46

[52] U.S. Cl. ..... 48/197 R; 48/65; 48/202; 48/206; 252/373

[58] Field of Search ..... 48/202, 65, 206, 197 R, 48/209, 111; 252/373; 219/121 P, 121 PY, 121 PR

[56] References Cited

U.S. PATENT DOCUMENTS

| | | | |
|---|---|---|---|
| 2,593,257 | 4/1952 | Bradley et al. | 48/206 |
| 2,931,715 | 4/1960 | Eastman | 48/206 |
| 3,294,952 | 12/1966 | Eschenbach | 219/121 P |
| 3,779,182 | 12/1973 | Camacho | 219/75 |
| 3,841,239 | 10/1974 | Nakamura et al. | 110/234 |
| 3,920,417 | 11/1975 | Fernandes | 48/202 |
| 3,957,458 | 5/1976 | Squires | 252/373 |
| 4,052,173 | 10/1977 | Schulz | 48/209 |
| 4,056,704 | 11/1977 | Beach et al. | 219/121 P |
| 4,362,554 | 12/1982 | Santen | 48/202 |

FOREIGN PATENT DOCUMENTS

| | | | |
|---|---|---|---|
| 2403885 | 7/1975 | Fed. Rep. of Germany . | |
| 2836472 | 8/1978 | Fed. Rep. of Germany . | |
| 2741805 | 3/1979 | Fed. Rep. of Germany | 48/206 |
| 79061818 | 7/1979 | Sweden . | |

*Primary Examiner*—Peter F. Kratz

*Attorney, Agent, or Firm*—Brumbaugh, Graves, Donohue & Raymond

[57] ABSTRACT

In a process for manufacturing a gas substantially containing carbon monoxide and hydrogen gas from a starting material containing carbon and/or hydrocarbon, the starting material is injected in powder or liquid form together with an oxidizing agent and slag former in a combustion zone while heat energy is simultaneously supplied. The combustion zone is formed in the lower portion of a shaft filled with particulate, solid, carbonaceous material and sulphur-binding slag former.

7 Claims, 1 Drawing Figure

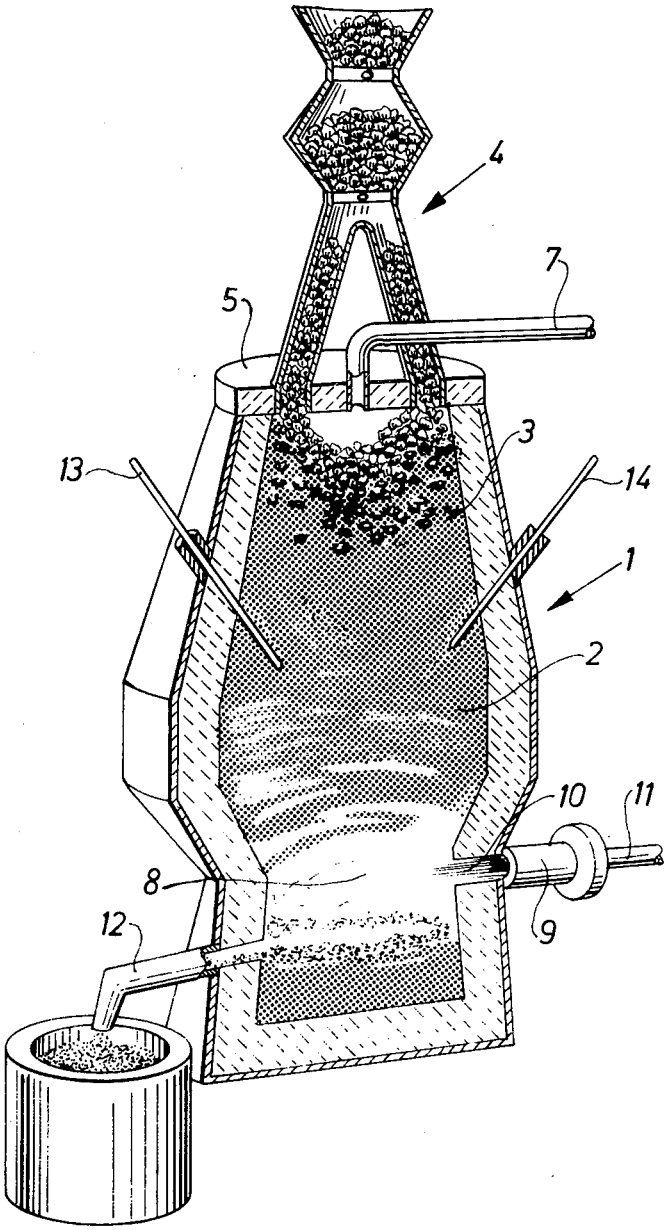
4
7
5
3
13
14
1
2
10
11
8
9
12

MANUFACTURE OF A GAS CONTAINING MONOXIDE AND HYDROGEN GAS FROM A STARTING MATERIAL CONTAINING CARBON AND/OR HYDROCARBON

DESCRIPTION

The present invention relates to a method and a device for the manufacture of a gas substantially containing carbon monoxide and hydrogen gas from a starting material containing carbon and/or hydrocarbon.

It is a main purpose of the invention to manufacture from solid or fluid carbonaceous fuels a combustible gas substantially composed of carbon monoxide and hydrogen and having a low sulphur content while any sulphur present is simultaneously incorporated in a slag.

Processes known so far for the manufacture of such gases require much energy and also employ a more or less complicated procedure. In addition, gases manufactured according to these processes exhibit, for example, high sulphur contents and high residues of carbon dioxide and water, thus yielding products which are particularly undesirable from the environmental point of view.

The present invention provides a method of manufacturing a gas containing carbon monoxide and hydrogen gas from a starting material containing carbon and/or hydrocarbon, in which the starting material is injected in powder or liquid form together with an oxidising agent and slag former into a combustion zone with simultaneous supply of heat energy, said combustion zone being formed in the lower part of a shaft filled with particulate, solid, carbonaceous material and sulphur-binding slag former.

This method makes it possible to eliminate many of the problems associated with the prior art and may, for example, advantageously be used for the manufacture of reducing gas for chemical processes, fuel suitable as a substitute for oil, gas for driving gas turbines and gas for metallurgical furnaces.

The gas manufactured in this way according to the invention has a low sulphur content and low residues of carbon dioxide and water in comparison with prior art procedures. Another advantage with the procedure of the invention resides in the fact that the sulphur is incorporated in a slag phase, which is particularly favourable environmentally and which, for example, does not involve the formation of hydrogen sulphide. In addition, the gas manufactured according to the invention is substantially free from higher hydrocarbons.

By the procedure of the invention it is also possible to control the process simply, because there is a fuel buffer in the shaft. Accordingly, the precise requirements for supply of oxygen gas and fuel powder to the shaft are reduced, since a deviation in the ratio between oxygen gas and fuel powder does not cause the quality of the discharged gas to deteriorate.

Suitably, according to the invention, lime or dolomite are used as sulphur-binding slag former and a gas mixture containing oxygen and/or water as oxidising agent.

According to a preferred embodiment of the invention it is possible to control the temperature and hydrogen content of the gas manufactured in the shaft by supplying water in the upper part of the shaft, i.e. above the combustion zone, while at the same time the physical heat content of the gas is made use of.

According to a further embodiment of the invention, the speed of combustion and the temperature can be controlled by controlled supply of heat energy to the combustion zone, this control being performed, for example, by heating the oxidising agent. According to a preferred embodiment of the invention a plasma generator is used as the heat source.

The present invention also provides a device for carrying out the process, this device comprising a shaft-like reactor filled with a mixture of particulate, solid, carbonaceous material and sulphur-binding slag former, this reactor having means for supplying the starting material containing carbon and/or hydrocarbons, said means leading to a combustion zone in the lower portion of the shaft, as well as a discharge conduit for continuous removal of the slag formed and a gas discharge conduit provided in the upper part of the reactor as well as devices for supplying additional heat energy if required. Suitably the reactor is provided with water supplying means having their discharge opening above the combustion zone.

The invention will now be described in detail by reference to an embodiment shown in the FIGURE of the accompanying Drawing.

A shaft-like reactor 1 is filled with a mixture of particulate, solid, carbonaceous material, such as black coal or coke and sulphur-binding slag former. The mixture 2 is supplied to the upper part 3 of shaft 1 via a furnace throat 4 having gas-tight supply sluices. The upper part of the shaft is covered by a lock 5 in which a central gas outlet 7 is provided.

In the lower part of shaft 1 a combustion zone 8 is provided, for example by means of a plasma burner 9, which also may be used for supplying a mixture 10 of a starting material in powder or liquid form containing carbon and/or hydrocarbon as well as slag former and oxidising agent. Also a supply device 11 for water terminates in the combustion zone 8. Moreover a spout 12 is provided for tapping the slag from the lower portion of shaft 1. In addition, devices 13, 14 for supplying water are provided having their discharge ends above the combustion zone 8 proper.

The starting material containing carbon and/or hydrocarbon is thus injected in powder or liquid form together with the oxidising agent, such as oxygen gas, and slag former, preferably acid slag former, into the combusion zone 8, the speed of combustion and the temperature easily being controlled by supply of heat energy to the combustion zone. This may be obtained either by heating the oxygen gas supplied or by using a plasma generator 9. In addition, by means of the water supply devices 13, 14 provided above the combustion zone the temperature and hydrogen content of the gas formed can be controlled, while at the same time the physical heat content of the gas is made use of.

The apparatus illustrated in the drawing may, for example, be operated as in the following Example:

EXAMPLE

By supplying the combustion zone 8 of shaft 1 with
610 $m^3$ oxygen gas,
1000 kg coal in powder form,
50 kg slag former ($Al_2O_3$=20%, $SiO_2$=80%)
and simultaneous water supply via supply device 11 in an amount of 330 liters,
2635 $m^3$ outlet gas were obtained having a temperature of 950° C. and a composition of $CO_2$: 3.3%
CO: 58.4%
$H_2$: 34.6%

$H_2O$: 2.9%

$N_2$: 1.3% as well as 240 kg slag. The filling of the shaft comprised 70 kg coke and 120 kg limestone and the temperature in the combustion zone amounted to about 1500° C. The energy requirement was 450 kWh.

We claim:

1. A method of manufacturing a gas containing carbon monoxide and hydrogen gas in a shaft reactor from a starting material containing carbon and/or hydrocarbon, comprising injecting the starting material in powder or liquid form together with an oxidizing agent and slag former into a combustion zone in the lower portion of the shaft reactor, said combustion zone being formed in the lower portion of said shaft by injecting a plasma gas from a plasma generator into said lower portion, said shaft being maintained substantially filled with particulate, solid, carbonaceous material and sulphur-binding slag former.

2. A method according to claim 1, in which the sulphur-binding slag former is lime or dolomite.

3. A method according to claim 1 in which the oxidizing agent is a gas mixture containing oxygen and/or water.

4. A method according to claim 1 including controlling the temperature and hydrogen content of the gas manufactured in the shaft by supplying water to the upper part of the shaft, and utilizing the physical heat content of the gas.

5. A method according to any one of the preceding claims, in which control of speed of combustion and temperature is achieved by controlling the supply of heat energy to the combustion zone.

6. A method according to claim 5, in which the control is at least partially performed by heating the oxidizing agent.

7. A method according to claim 5, in which the heating is performed in the plasma generator.

* * * * *

UNITED STATES PATENT AND TRADEMARK OFFICE

CERTIFICATE OF CORRECTION

PATENT NO. : 4,466,807

DATED : August 21, 1984

INVENTOR(S) : Sven SANTEN et al

It is certified that error appears in the above-identified patent and that said Letters Patent is hereby corrected as shown below:

On the cover page, Item [54], the title should read: MANUFACTURE OF A GAS CONTAINING --CARBON-- MONOXIDE AND HYDROGEN GAS FROM A STARTING MATERIAL CONTAINING CARBON AND/OR HYDROCARBON.

Column 1, the title should read: MANUFACTURE OF A GAS CONTAINING --CARBON-- MONOXIDE AND HYDROGEN GAS FROM A STARTING MATERIAL CONTAINING CARBON AND/OR HYDROCARBON.

Signed and Sealed this

Eighteenth Day of November, 1986

*Attest:*

DONALD J. QUIGG

*Attesting Officer* *Commissioner of Patents and Trademarks*